US009551151B2

(12) United States Patent
Lee et al.

(10) Patent No.: US 9,551,151 B2
(45) Date of Patent: Jan. 24, 2017

(54) APPARATUS FOR COUPLING REINFORCING BAR USING HYDRAULIC PRESSURE

(71) Applicant: Jong-youl Lee, Yangsan-si, Gyeongsangnam-do (KR)

(72) Inventors: Jong Ryul Lee, Busan (KR); Jun-woo Song, Busan (KR)

(73) Assignee: Jong Ryul Lee (KR)

( * ) Notice: Subject to any disclaimer, the term of this patent is extended or adjusted under 35 U.S.C. 154(b) by 0 days.

(21) Appl. No.: 14/817,448

(22) Filed: Aug. 4, 2015

(65) Prior Publication Data

US 2015/0337533 A1 Nov. 26, 2015

Related U.S. Application Data

(63) Continuation of application No. PCT/KR2014/004198, filed on May 9, 2014.

(30) Foreign Application Priority Data

Aug. 28, 2013 (KR) ..... 10-2013-0102200

(51) Int. Cl.
*E04C 5/00* (2006.01)
*E04C 5/16* (2006.01)

(52) U.S. Cl.
CPC ..... *E04C 5/165* (2013.01); *Y10T 403/5793* (2015.01)

(58) Field of Classification Search
CPC ..... E04C 5/165; E04C 5/16; E04G 21/12; Y10T 403/5793
See application file for complete search history.

(56) References Cited

U.S. PATENT DOCUMENTS 1,458,395 A * 6/1923 Cunningham ..... F16D 1/02 403/314
1,727,896 A * 9/1929 Mraz ..... H01R 4/20 24/23 W
2,659,062 A * 11/1953 Tibbetts ..... H01R 4/5033 174/84 S
2,768,433 A * 10/1956 O'Donnell ..... B23P 11/025 29/447
3,049,775 A * 8/1962 Ondeck ..... E04C 5/122 24/335
3,253,332 A * 5/1966 Howlett ..... E04C 5/165 285/323
3,551,999 A * 1/1971 Gutmann ..... B21D 39/04 29/517
3,681,512 A * 8/1972 Werner ..... H01R 4/08 102/202.9

(Continued)

*Primary Examiner* — Victor MacArthur
(74) *Attorney, Agent, or Firm* — Park & Associates IP Law, P.C.

(57) ABSTRACT

A coupling apparatus presses conical members having curved surfaces in a direction perpendicular to reinforcing bars by using hydraulic pressure, thereby considerably reducing working time for coupling reinforcing bars, completely securing the reinforcing bars and increasing compressive and bending strength. It is possible to stably carry force from the conical members through external force dispersion medium members to reinforcing bar securing members. Accordingly, there is a structural advantage of effectively preventing the displacement and the loosening of the coupled reinforcing bars.

7 Claims, 9 Drawing Sheets

(56) References Cited

U.S. PATENT DOCUMENTS

| | | | | | |
|---|---|---|---|---|---|
| 3,729,218 | A * | 4/1973 | Gutmann | E04C 5/165 | 403/274 |
| 3,769,678 | A * | 11/1973 | Marsden | B21D 39/046 | 29/252 |
| 3,850,535 | A * | 11/1974 | Howlett | E04C 5/165 | 403/305 |
| 4,146,951 | A * | 4/1979 | Howlett | E04C 5/122 | 29/452 |
| 5,127,763 | A * | 7/1992 | Kunoki | F16B 2/14 | 403/314 |
| 5,193,932 | A * | 3/1993 | Wu | E04C 5/165 | 403/307 |
| 5,909,980 | A * | 6/1999 | Holdsworth | E04C 5/165 | 403/265 |
| 5,967,691 | A * | 10/1999 | Lancelot, III | E04C 5/165 | 403/296 |
| 6,571,452 | B1 * | 6/2003 | Wang | B21K 1/56 | 29/557 |
| 6,719,478 | B2 * | 4/2004 | Gregel | B25B 27/10 | 403/300 |
| 6,966,104 | B2 * | 11/2005 | Gregel | B25B 27/10 | 269/231 |
| 7,032,286 | B2 * | 4/2006 | Wang | B21K 1/56 | 29/508 |
| 7,118,299 | B2 * | 10/2006 | Gregel | B25B 27/10 | 403/305 |
| 2003/0000274 | A1 * | 1/2003 | Buhler | B21F 5/00 | 72/318 |
| 2003/0198513 | A1 * | 10/2003 | Wang | B21K 1/56 | 403/362 |
| 2013/0093236 | A1 * | 4/2013 | Marshall | E21C 35/00 | 299/10 |

* cited by examiner

APPARATUS FOR COUPLING REINFORCING BAR USING HYDRAULIC PRESSURE

REFERENCE TO RELATED APPLICATIONS

This is a continuation of pending International Patent Application PCT/KR2014/004198 filed on May 9, 2014, which designates the United States and claims priority of Korean Patent Application No. 10-2013-0102200 filed on Aug. 28, 2013, the entire contents of which are incorporated herein by reference.

FIELD OF THE INVENTION

The present invention relates to a technology of a coupling apparatus that couples opposed ends of a pair of reinforcing bars.

BACKGROUND OF THE INVENTION

This invention relates to a reinforcing bar coupling apparatus that can carry tension that is applied to reinforcing bars by mechanically coupling the opposed ends of the reinforcing bars without coupling the reinforcing bars by overlapping them while the reinforcing bars are used in reinforced concrete construction. The opposed ends of the reinforcing bars are enabled to be coupled by contacting with members securing the opposed ends of the reinforcing bars and instantly applying strong external forces by hydraulic pressure to the members.

Referring to a related art reinforcing bar coupling apparatus (see FIG. 12), the related art coupling apparatus is provided with a pair of coupling members 12, whose inner surface has a plurality of joint grooves 12*b* and opposite ends of an outer surface have respective male threads 12*a*. The related art coupling apparatus includes sleeve couplings 11 that have a through-hole 11*b* in the center of each of the sleeve couplings and female threads 11*a* on an inner surface of the through-hole 11*b* so that the sleeve couplings 11 can be screwed to the externally threaded opposite ends of the outer surfaces of the coupling members 12. The reinforcing bar coupling apparatus 10 is structured in the manner that after two reinforcing bars 1 having multiple joint protrusions 1*a* are linearly arranged to be in contact with each other at opposed ends thereof, the pair of coupling members 12 are combined with the reinforcing bars 1 so that the joint protrusions 1*a* of the reinforcing bars 1 fit into the joint grooves 12*b* by locating the junction of the two reinforcing bars 1 in the midpoint of the inside of the coupling members 12. Thereafter, the sleeve couplings 11 having the through-holes 11*b* are fitted over the reinforcing bars 1, and the sleeve couplings 11 are screwed to the male threads 12*a* and manually tightened to be combined with the male threads 12*a*. Accordingly, the reinforcing bars 1 are integrally combined with the pair of coupling members 12, so that the reinforcing bars 1 are coupled together. However, the reinforcing bar coupling apparatus 10 of the related art is problematic in that when the opposed ends of the reinforcing bars 1 to be coupled are not accurately cut, the opposed ends of the reinforcing bars 1 may not be in close contact with each other inside the reinforcing bar coupling apparatus 10. Accordingly, the reinforcing bars 1 may sway inside of the reinforcing bar coupling apparatus 10. In addition, to couple two reinforcing bars 1 using the coupling apparatus 10 of the related art, the two coupling members are arranged to face each other and compressed by the combination of the sleeve couplings. However, when coupling the two reinforcing bars, the coupling members may not apply enough compressive force to the reinforcing bars. This problem causes the coupled reinforcing bars inside the reinforcing bar coupling apparatus to be loosened, or to move, so that the compressive or bending strength of the coupled reinforcing bars is weakened at the coupled junction, and thus a reinforced concrete structure has decreased rigidity to compression or bending.

SUMMARY OF THE INVENTION

The present invention is intended to propose a coupling apparatus that enables the perfect securing of reinforcing bars and enhancing the compressive and bending strength by applying hydraulic pressure to conical members vertical to the reinforcing bars so that the work of coupling the reinforcing bars can be done with quickness and accuracy.

Accordingly, the present invention provides an apparatus for coupling reinforcing bars by using hydraulic pressure, the apparatus including:

first and second bodies 100 and 250 into which reinforcing bars are inserted to pass through the inside of the first and second bodies, with receiving holes 105, 106, 252, and 253 provided on upper and lower surfaces of the first and second bodies;

a pair of conical members 400 and 401 that are inserted into receiving holes 105 and 106 of the first body 100 and receiving holes 252 and 253 of the second body 250 respectively, wherein the receiving holes 105 and 106 of the first body 100 correspond to the receiving holes 252 and 253 of the second body 250;

a plurality of reinforcing bar securing members 200, 201, 202, and 203 inserted into the first and second bodies 100 and 250 in such a way that the plurality of reinforcing bar securing members are spaced from outer surfaces of the inserted reinforcing bars, with reinforcing bar locking ridges 200*b*, 201*b*, 202*b*, and 203*b* provided on inner surfaces of the reinforcing bar securing members; and a hydraulic pressure applying unit for inserting the conical members 400 and 401 into the first and second bodies 100 and 250 through the receiving holes 105, 106, 252, and 253 of the first and second bodies 100 and 200, wherein when tension is applied to the reinforcing bars, the reinforcing bar securing members 200, 201, 202, and 203 compress the reinforcing bars and push jaw elements D1, D2, D3, and D4 of inner surfaces of the first and second bodies 100 and 200, thereby preventing movement of the reinforcing bars, wherein edges of first surfaces of the reinforcing bar securing members 200, 201, 202, and 203 are provided with indentations 200*a*, 201*a*, 202*a*, and 203*a* corresponding to curve-sided surfaces 400*a* and 401*a* of the conical members 400 and 401, so that when the conical members 400 and 401 are inserted into the first and second bodies 100 and 250, the conical members 400 and 401 come in contact with the indentations 200*a*, 201*a*, 202*a*, and 203*a*, thereby carrying forces.

The details are additionally described in the following embodiments.

The present invention is advantageous as follows.

The coupling apparatus of the present invention presses conical members having curved surfaces in a direction perpendicular to reinforcing bars by using hydraulic pressure, thereby considerably reducing working time for coupling reinforcing bars, completely securing the reinforcing bars and increasing compressive and bending strength.

Particularly, the present invention can stably carry force from the conical members through external force dispersion medium members to reinforcing bar securing members. Accordingly, there is a structural advantage of effectively preventing the displacement and the loosening of the coupled reinforcing bars.

DETAILED DESCRIPTION OF THE INVENTION

Figure 1:
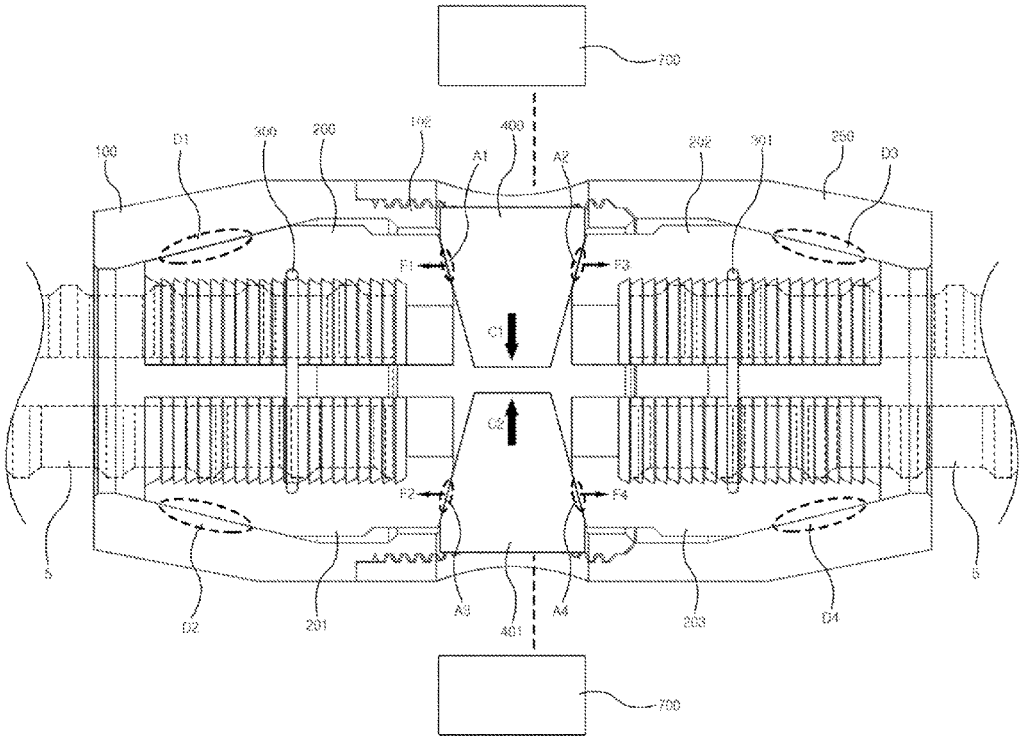
FIGS. 1 to 5 are views illustrating a first embodiment of the present invention.
Figure 2:
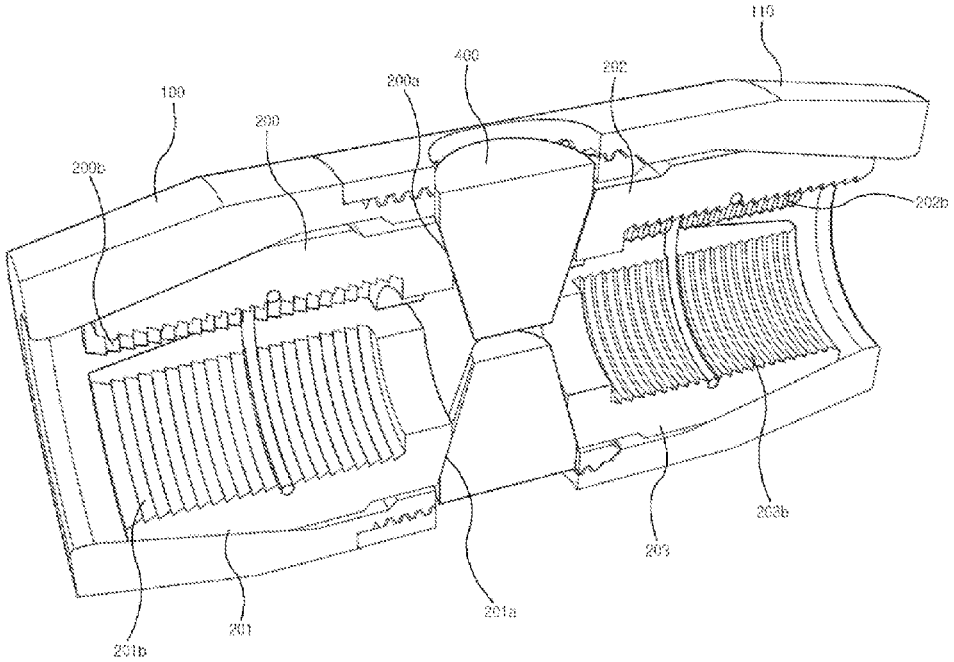

Exemplary embodiments of the present invention below are illustrated in detail by referring to the drawings.

The claims of the present invention should be grasped equivalent to the claims of those skilled in the art, and the claims should not be reduced by the embodiments.

The present invention will be described hereinbelow.

The first embodiment of the present invention provides an apparatus for coupling reinforcing bars 5 by using hydraulic pressure, the apparatus including:

first and second bodies 100 and 250 into which reinforcing bars 5 are inserted to pass through the inside of the first and second bodies, with receiving holes 105, 106, 252, and 253 provided on upper and lower surfaces of the first and second bodies;

a pair of conical members 400 and 401 that are inserted into receiving holes 105 and 106 of the first body 100 and receiving holes 252 and 253 of the second body 250 respectively, wherein the receiving holes 105 and 106 of the first body 100 correspond to the receiving holes 252 and 253 of the second body 250;

a plurality of reinforcing bar securing members 200, 201, 202, and 203 inserted into the first and second bodies 100 and 250 in such a way that the plurality of reinforcing bar securing members are spaced from outer surfaces of the inserted reinforcing bars, with reinforcing bar locking ridges 200*b*, 201*b*, 202*b*, and 203*b* provided on inner surfaces of the reinforcing bar securing members; and a hydraulic pressure applying unit 700 for inserting the conical members 400 and 401 into the first and second bodies 100 and 250 through the receiving holes 105, 106, 252, and 253 of the first and second bodies 100 and 200, wherein when tension is applied to the reinforcing bars, the reinforcing bar securing members 200, 201, 202, and 203 compress the reinforcing bars and push jaw elements D1, D2, D3, and D4 of inner surfaces of the first and second bodies 100 and 200, thereby preventing movement of the reinforcing bars, wherein edges of first surfaces of the reinforcing bar securing members 200, 201, 202, and 203 are provided with indentations 200*a*, 201*a*, 202*a*, and 203*a* corresponding to curve-sided surfaces 400*a* and 401*a* of the conical members 400 and 401, so that when the conical members 400 and 401 are inserted into the first and second bodies 100 and 250, the conical members 400 and 401 come in contact with the indentations 200*a*, 201*a*, 202*a*, and 203*a*, thereby carrying forces.

The following is a second embodiment.

The second embodiment of the present invention provides an apparatus for coupling reinforcing bars 5 by using hydraulic pressure, the apparatus including:

first and second bodies 100 and 250 into which reinforcing bars 5 are inserted to pass through the inside of the first and second bodies 100 and 250;

conical members 400 and 401 that are inserted into receiving holes 105 and 106 of the first body 100 and receiving holes 252 and 253 of the second body 250 respectively, wherein the receiving holes 105 and 106 of the first body 100 correspond to the receiving holes 252 and 253 of the second body 250;

a plurality of reinforcing bar securing members 204, 205, 206, 207, 208, and 209 inserted into the first and second bodies 100 and 250 in such a way that the plurality of reinforcing bar securing members are spaced from outer surfaces of the inserted reinforcing bars, with reinforcing bar locking ridges 204*b*, 205*b*, 206*b*, 207*b*, 208*b*, and 209*b* provided on inner surfaces of the reinforcing bar securing members;

a hydraulic pressure applying unit 700 for inserting the conical members 400 and 401 into the first and second bodies 100 and 250 through the receiving holes 105, 106, 252, and 253 of the first and second bodies 100 and 200; and a pair of external force dispersion medium members 600 and 601 facing each other, wherein first surfaces of the medium members are in contact with the conical members 400 and 401, and second surfaces of the medium members are in contact with butt end surfaces of the reinforcing bar securing members 204, 205, 206, 207, 208, and 209, wherein when tension is applied to the reinforcing bars, the reinforcing bar securing members 204, 205, 206, 207, 208, and 209 compress the reinforcing bars and push jaw elements D5, D6, D7, and D8 of inner surfaces of the first and second bodies 100 and 200, thereby preventing movement of the reinforcing bars, wherein edges of the first surfaces of the external force dispersion medium members 600 and 601 are provided with indentations 600*a*, 600*b*, 601*a*, and 601*b* corresponding to curved surfaces 400*a* and 401*a* of the conical members 400 and 401, so that when the conical members 400 and 401 are inserted into the first and second bodies 100 and 250, the conical members 400 and 401 come in contact with the indentations 600*a*, 600*b*, 601*a*, and 601*b* (by pressing and inserting the conical members into the first and second bodies), and subsequent contact forces F11, F21, F31, and F41 are carried to the external force dispersion medium members 600 and 601, and to the reinforcing bar securing members 204, 205, 206, 207, 208, and 209 that are in contact with circumferences of the second surfaces of the external force dispersion medium members 600 and 601.

Figure 11:
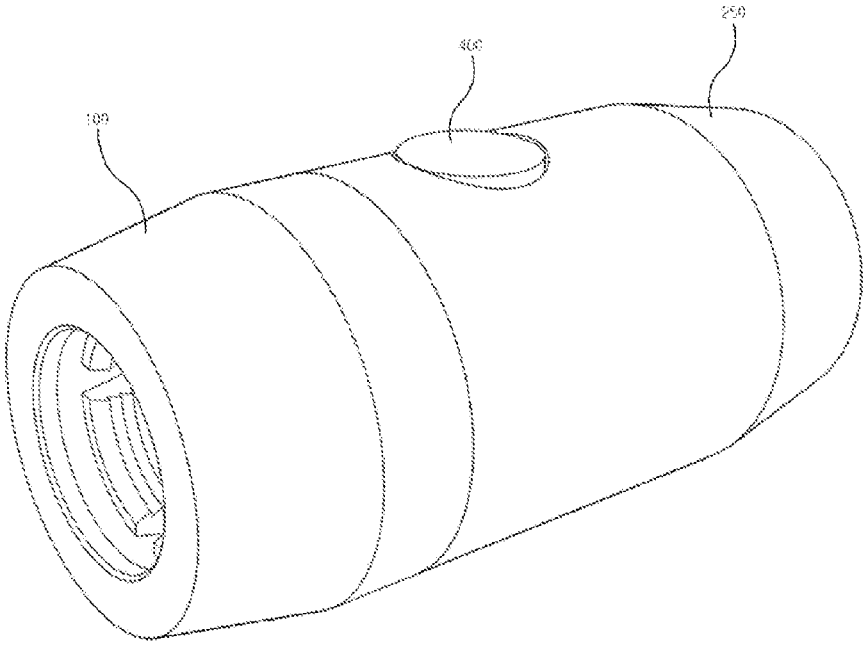
Figure 12:
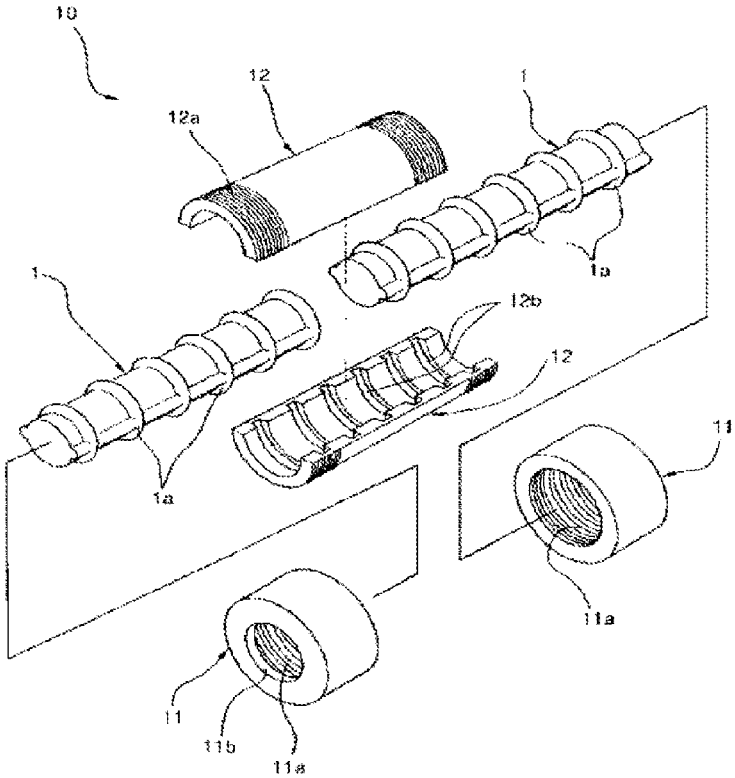
FIG. 12 (Prior Art)
FIG. 12 is a view illustrating a related art.

First, the appearance of the present invention is illustrated in FIG. 11. The first and second bodies 100 and 250 are screwed together, and reinforcing bars (not shown) are inserted into the first and second bodies 100 and 250 respectively. The upper surface and the lower surface of the first body 100 and the upper surface and the lower surface of the second body 250 are provided with the receiving holes. The conical members 400 and 401 having the predetermined curved sides are inserted into the receiving holes. Referring to FIGS. 1 to 5, the interior structure of the above-mentioned apparatus according to the first embodiment will be described.

Figure 3:
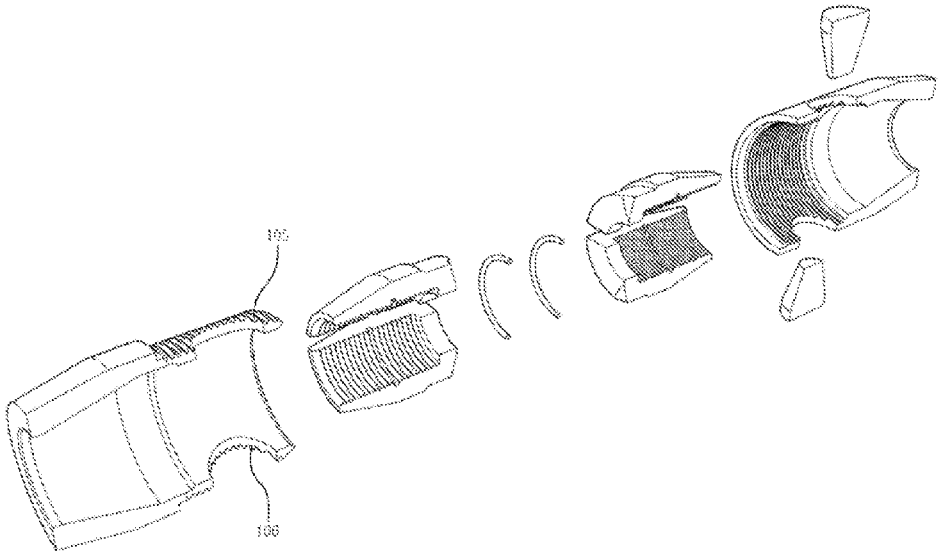
Figure 4:
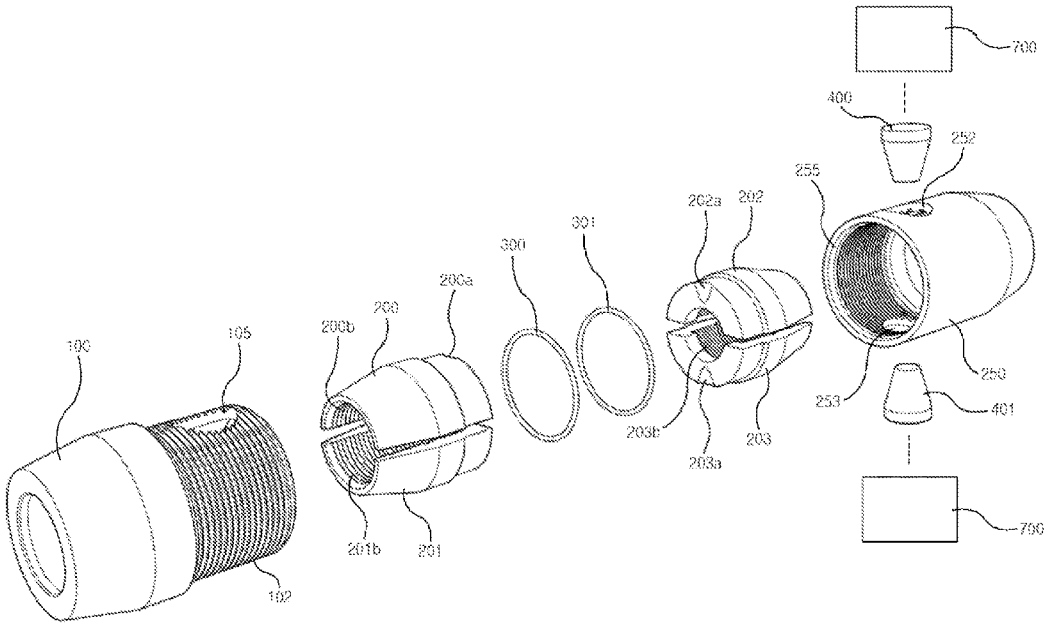
Figure 5:
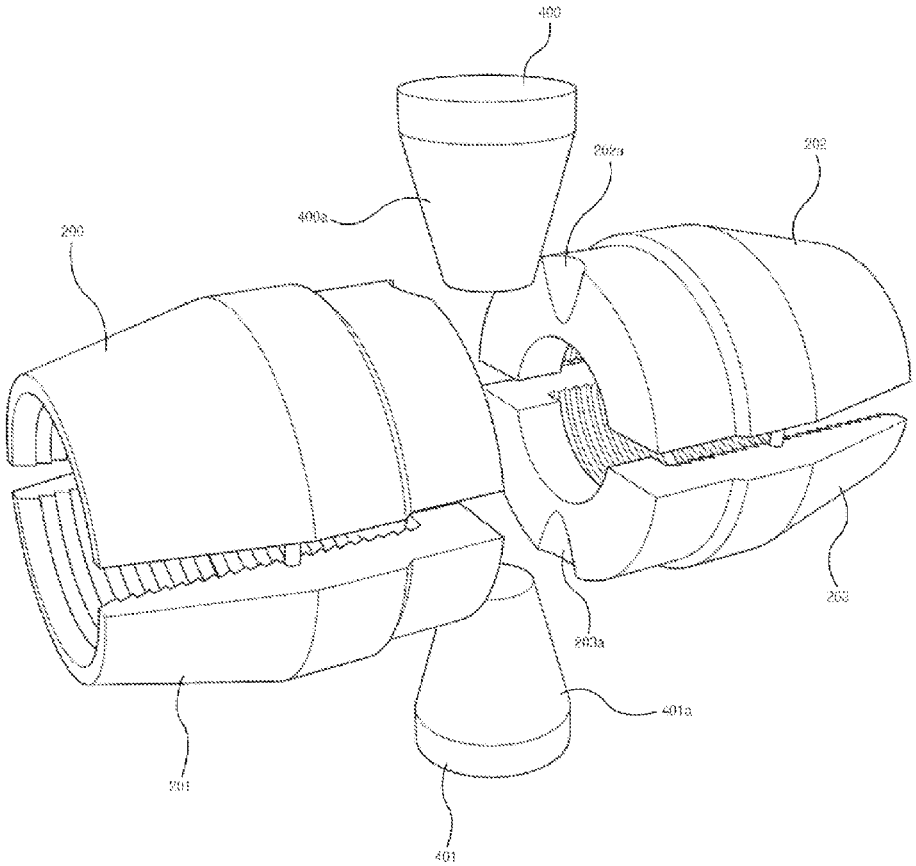

FIG. 1, FIG. 3, and FIG. 4 are a cross-sectional view, a perspective cross-sectional view, and an exploded perspective view of FIG. 11 respectively.

The first body 100 is provided with a hole in the center thereof that receives a reinforcing bar. The outer surface of the first body 100 is provided with threads 102. The size and form of the receiving hole 105 formed on an upper surface of the threads 102 correspond to the size and form of the receiving hole 252 formed on an upper surface of the second body 250.

The threads 102 of the first body 100 are screwed to threads 255 of the second body 250. As the inside of the receiving holes of the first body and the second body can be grasped through FIG. 2, the closer the holes are to the outer surfaces, the bigger the diameter of the holes grows and the father the holes are from the outer surfaces, the smaller the diameter of the holes grows.

The shape of the first and second bodies 100 and 250 corresponds to that of the reinforcing bar securing members 200, 201, 202, and 203 as illustrated in FIG. 4, so that the reinforcing bar securing members 200, 201, 202, and 203 are received into the first and second bodies 100 and 250. The number of the reinforcing bar securing members is four as illustrated in FIG. 4. Two reinforcing bar securing members are in a left side and a right side respectively. Of course, the number of the reinforcing bar securing members may be increased. Each of the two reinforcing bar securing members in the respective bodies is not combined but the reinforcing bar securing members in the first body are close to each other and are cylindrically formed. When external forces are applied to the reinforcing bars, the reinforcing bar securing members compress the reinforcing bars and strongly push the inner surfaces of the first and second bodies, thereby preventing the displacement and the loosening of the coupled reinforcing bars. This is made possible by the reinforcing bar locking ridges 200*b*, 201*b*, 202*b*, and 203*b* formed on the inner surfaces of the reinforcing bar securing members 200, 201, 202, and 203.

The butt end surfaces of the reinforcing bar securing members 200, 201, 202, and 203 are provided with indentations 200*a*, 201*a*, 202*a*, and 203*a* corresponding to curved surfaces 400*a* and 401*a* of the conical members 400 and 401. When the conical members 400 and 401 move from the position illustrated in FIG. 5 to the position illustrated in FIG. 1, the conical members 400 and 401 strongly push the indentations for receiving the curve-sided surfaces. Directions of the push are illustrated as F1, F2, F3, and F4 in FIG. 1. The pushing forces cause the reinforcing bar securing members to strongly push the inner surface of the first body through the jaw elements D1, D2, D3, and D4 and thus the inserted reinforcing bars are constrained by the reinforcing bar securing members.

The hydraulic pressure should be used to push the conical members in a direction (C1 and C2 in FIG. 1) perpendicular to the reinforcing bars.

Since when an ordinary worker manually pushes conical members, it is difficult to apply a sufficient compressive force to reinforcing bar securing members. Thus it is necessary to apply the compressive force to the flat portion of the heads of the conical members by using hydraulic pressure applying units. This compressing procedure performed by the conical members and the hydraulic pressure applying units for coupling reinforcing bars is unprecedented, so it is a unique technology.

Insert rings 300 and 301 may further be provided that wrap the outer surfaces of the reinforcing bars (Not shown in FIG. 1) and prevent the reinforcing bars from being displaced, wherein the insert rings 300 and 301 are located on surfaces of the reinforcing bar locking ridges provided on the inner surfaces of the reinforcing bar securing members.

Though the insert rings for preventing the displacement of the reinforcing bars are structurally simple, the insert rings fill the spaces that are between the reinforcing bars and the reinforcing bar securing members (200, 201, 202, and 203). Accordingly, the insert rings are very effective to minimize the displacement of the reinforcing members in a direction perpendicular to the length of the reinforcing bars. The number and the shape of the insert rings may be changed or modified.

FIG. 3 illustrates the half-cut of elements of FIG. 4.

Figure 6:
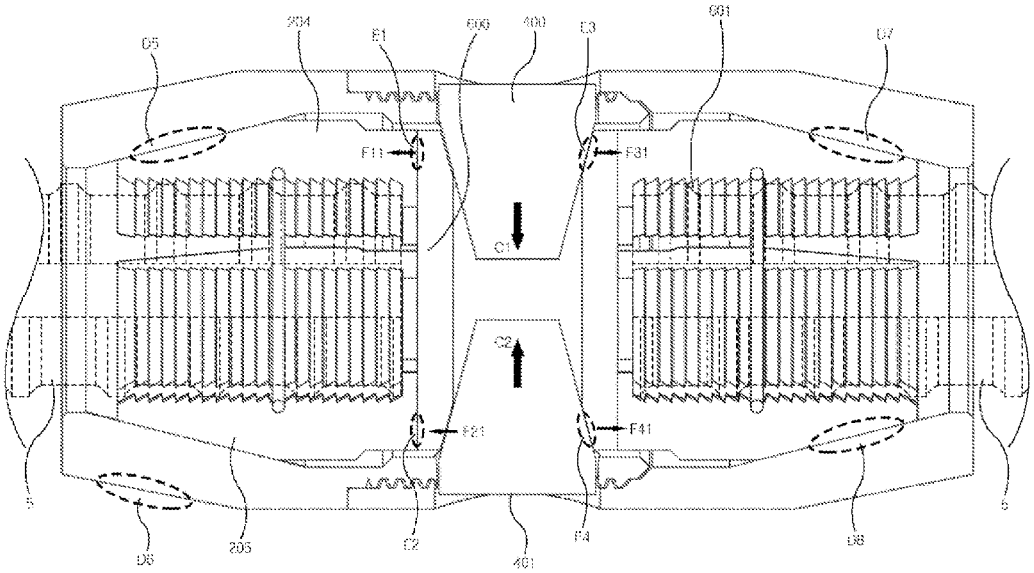
FIGS. 6 to 11 are views illustrating a second embodiment of the present invention.
Figure 7:
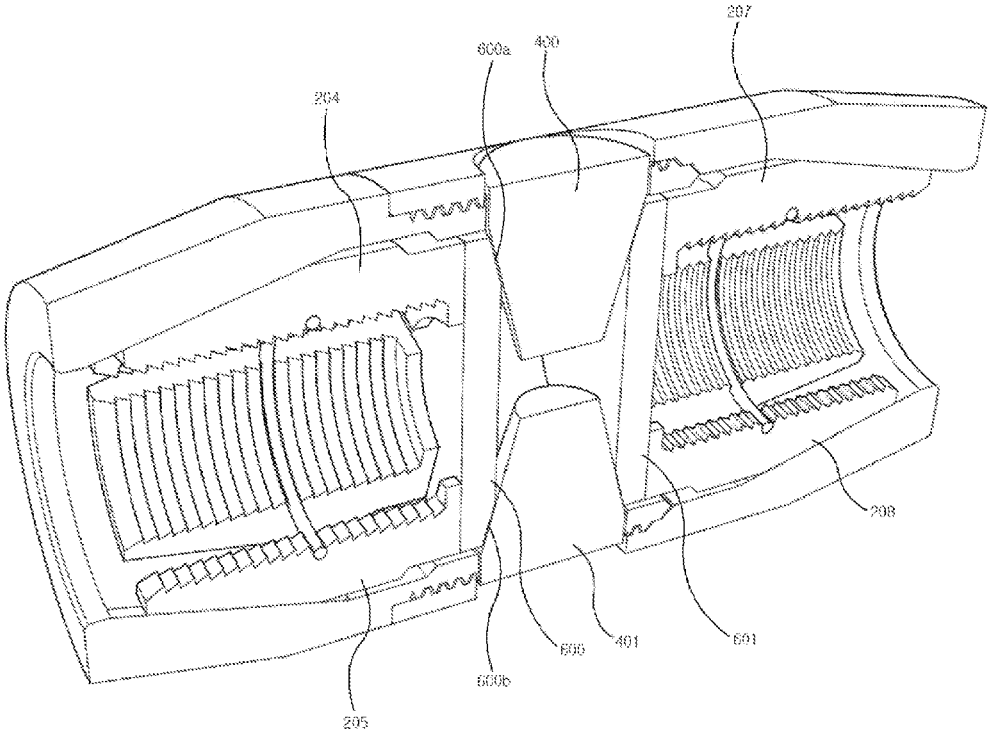
Figure 8:
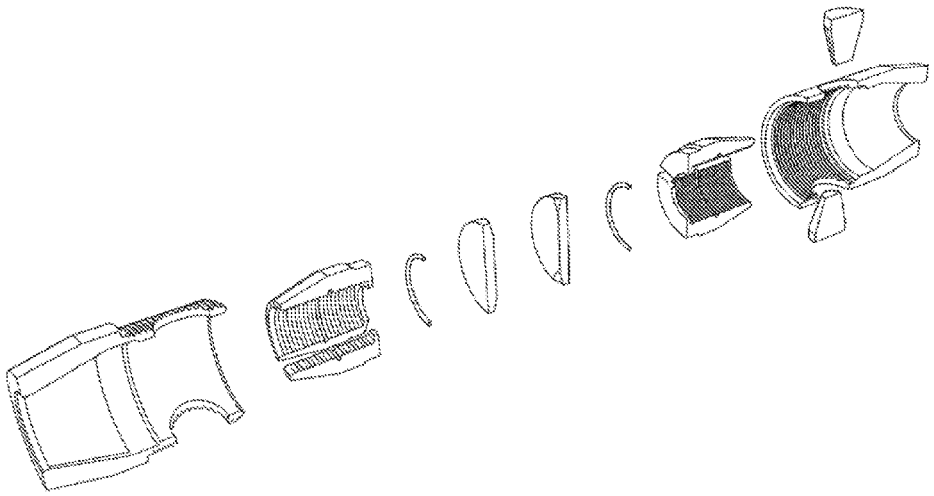
Figure 9:
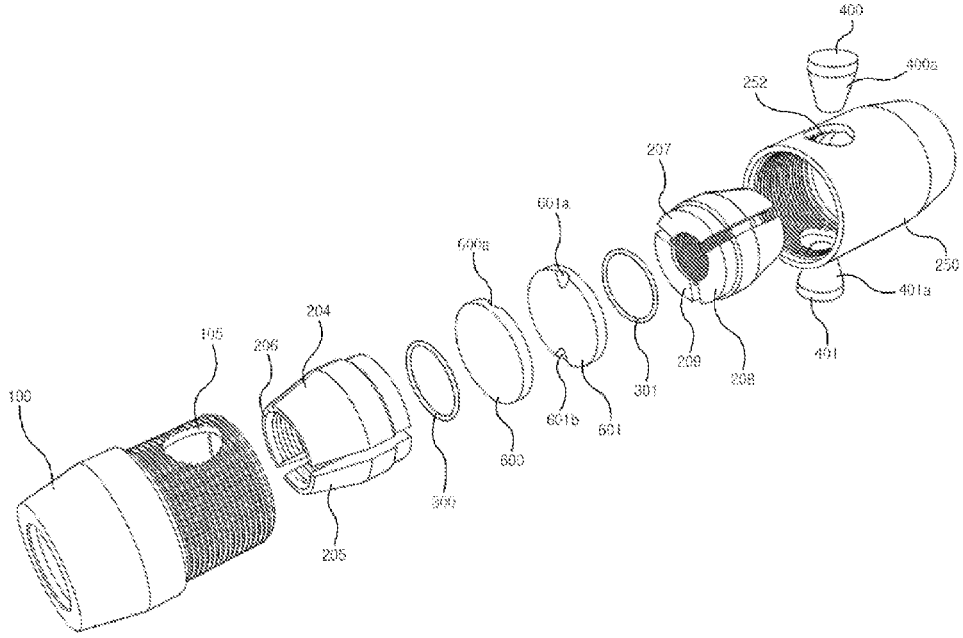

The second embodiment is illustrated with reference to the drawings below FIG. 6.

The second embodiment is different from the first embodiment in that the second embodiment further includes a pair of external force dispersion medium members 600 and 601 wherein forces from the conical members 400 and 401 are carried through external force dispersion medium members 600 and 601 to reinforcing bar securing members 204, 205, 206, 207, 208, and 209.

The reinforcing bar locking ridges 204*b*, 205*b*, 206*b*, 207*b*, 208*b*, and 209*b* are provided in the reinforcing bar securing members.

An illustration is omitted as to what the second embodiment has in common with the first embodiment and is centered on the differences between the first embodiment and the second embodiment.

According to the first embodiment, the conical members 400 and 401 come in direct contact with the reinforcing bar securing members 200, 201, 202, and 203 as illustrated in FIG. 1. In this case, the contact areas are very small as illustrated with A1, A2, A3, and A4 of FIG. 1. Since the forces from the conical members are carried to the reinforcing bar securing members only through the small contact areas, the efficiency of conveying the forces may slightly decrease in terms of stability of delivering forces. However, since the forces from conical members are more stably carried to the reinforcing bar securing members according to the second embodiment, the displacement and the loosening of the coupled reinforcing bars can be effectively prevented.

When forces from conical members are carried to the respective reinforcing bar securing members 204, 205, 206, 207, 208, and 209 that are spaced from each other as individual members through small contact areas as in the first embodiment, the conical members or the reinforcing bar securing members are made unstable while they are under external vibration conditions. The following embodiment is proposed considering the instability of the small contact areas.

In other words, external force dispersion medium members 600 and 601 of plate form are located between the conical members 400 and 401 and the reinforcing bar securing members 204, 205, 206, 207, 208, and 209. Accordingly, the contact forces (See F11, F21, F31, F41 in FIG. 6) from the conical members 400 and 401 are carried to the indentations 600*a*, 600*b*, 601*a*, and 601*b* formed in the first surface of the external force dispersion medium member 600 and 601. As a result, the contact forces are carried to the reinforcing bar securing members 204, 205, 206, 207, 208, and 209 that make contact with the circumference of the second surface of the external force dispersion medium members.

In this case, since the butt end surfaces of the plurality of reinforcing bar securing members come in contact with the circumferences of the coin-shaped external force dispersion medium members, the forces caused by pressing and inserting the conical members are distributed to stably secure the reinforcing bars.

Figure 10:
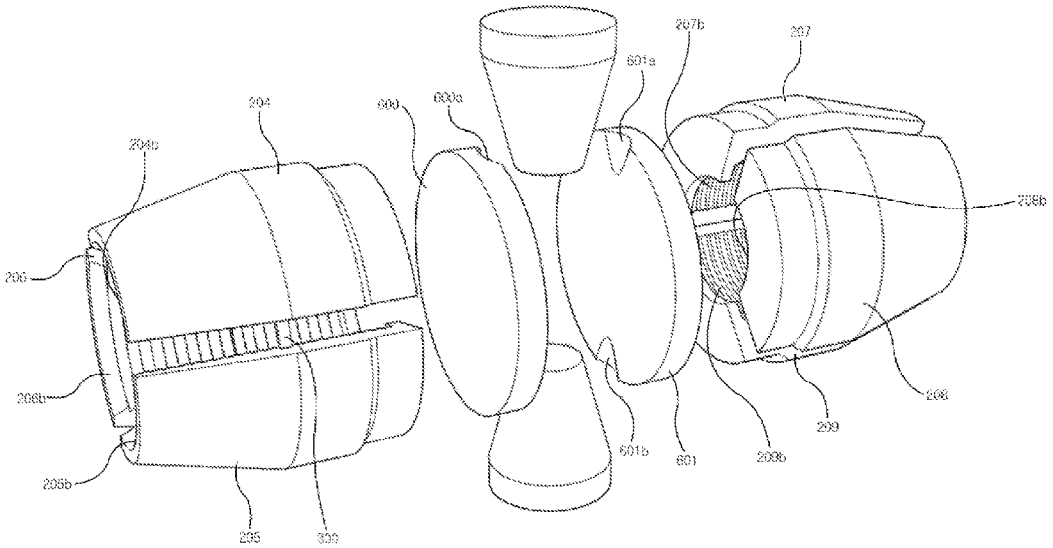

In this case, with the butt end surfaces of the reinforcing bar securing members coming in contact with surfaces of the circumferences of the external force dispersion medium members, this structure stably secures the reinforcing bars. Referring to FIG. 6 and FIG. 10, the external force dispersion medium member 600 makes contact with the right-side butt end surface of the reinforcing bar securing member, that is, with the circumference thereof.

Though it is illustrated that the second embodiment has more reinforcing bar securing members than the first embodiment, changing the number of the reinforcing bar securing members does not affect the essence of the present invention.

To summarize the advantages of the present invention, the present invention is a coupling apparatus that presses conical members having curve-sided surfaces in a direction perpendicular to reinforcing bars by using hydraulic pressure, thereby considerably reducing working time for coupling reinforcing bars, completely securing the reinforcing bars and increasing compressive and bending strength. It is possible to stably carry forces from the conical members through external force dispersion medium members to reinforcing bar securing members. Accordingly, there are structural advantages of effectively preventing the displacement and the loosening of the coupled reinforcing bars.

The present invention is available in the technical field relevant to a coupling apparatus connecting the opposed ends of a pair of reinforcing bars.

What is claimed is:

1. An apparatus for coupling reinforcing bars by using hydraulic pressure, the apparatus comprising:

first and second bodies (100 and 250) into which reinforcing bars are inserted to pass through the inside of the first and second bodies (100 and 250);

conical members (400 and 401) that are inserted into receiving holes (105 and 106) of the first body (100) and receiving holes (252 and 253) of the second body (250) respectively, wherein the receiving holes (105 and 106) of the first body (100) correspond to the receiving holes (252 and 253) of the second body (250);

a plurality of reinforcing bar securing members (204, 205, 206, 207, 208, and 209) inserted into the first and second bodies (100 and 250) in such a way that the plurality of reinforcing bar securing members are spaced from outer surfaces of the inserted reinforcing bars, with reinforcing bar locking ridges (204*b*, 205*b*, 206*b*, 207*b*, 208*b*, and 209*b*) provided on inner surfaces of the reinforcing bar securing members;

a hydraulic pressure applying unit for inserting the conical members (400 and 401) into the first and second bodies (100 and 250) through the receiving holes (105, 106, 252, and 253) of the first and second bodies (100 and 200); and a pair of external force dispersion medium members (600 and 601) facing each other, wherein first surfaces of the medium members are in contact with the conical members (400 and 401), and second surfaces of the medium members are in contact with butt end surfaces of the reinforcing bar securing members (204, 205, 206, 207, 208, and 209), wherein when tension is applied to the reinforcing bars, the reinforcing bar securing members (204, 205, 206, 207, 208, and 209) compress the reinforcing bars and push jaw elements (D5, D6, D7, and D8) of inner surfaces of the first and second bodies (100 and 200), thereby preventing movement of the reinforcing bars, wherein edges of the first surfaces of the external force dispersion medium members (600 and 601) are provided with indentations (600*a*, 600*b*, 601*a*, and 601*b*) corresponding to curved surfaces (400*a* and 401*a*) of the conical members (400 and 401), so that when the conical members (400 and 401) are inserted into the first and second bodies (100 and 250), the conical members (400 and 401) come in contact with the indentations (600*a*, 600*b*, 601*a*, and 601*b*) (by pressing and inserting the conical members into the first and second bodies), and subsequent contact forces (F11, F21, F31, and F41) are carried to the external force dispersion medium members (600 and 601), and to the reinforcing bar securing members (204, 205, 206, 207, 208, and 209) that are in contact with circumferences of the second surfaces of the external force dispersion medium members (600 and 601).

2. The apparatus for coupling the reinforcing bars by using hydraulic pressure of claim 1, wherein the first and second bodies (100 and 250) are screwed together, and the jaw elements (D1, D2, D3, and D4) are inclined to directions in which the reinforcing bars are inserted into the first and second bodies (100 and 250).

3. The apparatus for coupling the reinforcing bars by using hydraulic pressure of claim 1, further comprising: insert rings (300 and 301) that wrap the outer surfaces of the reinforcing bars and prevent the reinforcing bars from being displaced, wherein the insert rings (300 and 301) are located on surfaces of the reinforcing bar locking ridges provided on the inner surfaces of the reinforcing bar securing members.

4. The apparatus for coupling the reinforcing bars by using hydraulic pressure of claim 1, wherein each of the external force dispersion medium members (600 and 601) is a coin-shaped plate, and the conical members (400 and 401) are in contact with the indentations (600*a*, 600*b*, 601*a*, and 601*b*) receiving the curved surfaces, so that the contact forces (F11, F21, F31, and F41) are distributed through the medium members (600 and 601) to the reinforcing bar securing members (204, 205, 206, 207, 208, and 209) that are in contact with circumferences of the medium members (600 and 601).

5. An apparatus for coupling reinforcing bars by using hydraulic pressure, the apparatus comprising:

first and second bodies (100 and 250) into which reinforcing bars are inserted to pass through the inside of the first and second bodies, with receiving holes (105, 106, 252, and 253) provided on upper and lower surfaces of the first and second bodies;

a pair of conical members (400 and 401) that are inserted into receiving holes (105 and 106) of the first body (100) and receiving holes (252 and 253) of the second body (250) respectively, wherein the receiving holes (105 and 106) of the first body (100) correspond to the receiving holes (252 and 253) of the second body (250);

a plurality of reinforcing bar securing members (200, 201, 202, and 203) inserted into the first and second bodies (100 and 250) in such a way that the plurality of reinforcing bar securing members are spaced from outer surfaces of the inserted reinforcing bars, with reinforcing bar locking ridges (200*b*, 201*b*, 202*b*, and 203*b*) provided on inner surfaces of the reinforcing bar securing members; and a hydraulic pressure applying unit for inserting the conical members (400 and 401) into the first and second bodies (100 and 250) through the receiving holes (105, 106, 252, and 253) of the first and second bodies (100 and

200), wherein when tension is applied to the reinforcing bars, the reinforcing bar securing members (200, 201, 202, and 203) compress the reinforcing bars and push jaw elements (D1, D2, D3, and D4) of inner surfaces of the first and second bodies (100 and 200), thereby preventing movement of the reinforcing bars, wherein edges of first surfaces of the reinforcing bar securing members (200, 201, 202, and 203) are provided with indentations (200*a*, 201*a*, 202*a*, and 203*a*) corresponding to curved surfaces (400*a* and 401*a*) of the conical members (400 and 401), so that when the conical members (400 and 401) are inserted into the first and second bodies (100 and 250), the conical members (400 and 401) come in contact with the indentations (200*a*, 201*a*, 202*a*, and 203*a*), thereby carrying forces.

6. The apparatus for coupling the reinforcing bars by using hydraulic pressure of claim 5, wherein the first and second bodies (100 and 250) are screwed together, and the jaw elements (D1, D2, D3, and D4) are inclined to directions in which the reinforcing bars are inserted into the first and second bodies (100 and 250).

7. The apparatus for coupling the reinforcing bars by using hydraulic pressure of claim 5, further comprising: insert rings (300 and 301) that wrap the outer surfaces of the reinforcing bars and prevent the reinforcing bars from being displaced, wherein the insert rings (300 and 301) are located on surfaces of the reinforcing bar locking ridges provided on the inner surfaces of the reinforcing bar securing members.

* * * * *